US005188050A

United States Patent [19]

Latham

[11] Patent Number: 5,188,050

[45] Date of Patent: Feb. 23, 1993

[54] CONVERTIBLE MAST ASSEMBLY

[76] Inventor: Steven B. Latham, 145 Bellevue Loop, Fayetteville, Ga. 32014

[21] Appl. No.: 779,782

[22] Filed: Oct. 21, 1991

[51] Int. Cl.[5] ..... B63H 9/00

[52] U.S. Cl. ..... 114/90; 114/93

[58] Field of Search ..... 114/39.1, 39.2, 102, 114/90, 93, 91

[56] References Cited

U.S. PATENT DOCUMENTS

| | | | |
|---|---|---|---|
| 3,270,494 | 9/1966 | Holmes | 114/108 |
| 4,311,107 | 1/1982 | Imre | 114/90 |
| 4,697,534 | 10/1987 | Kettlestrings | 114/90 |
| 4,757,778 | 7/1988 | Scaglia | 114/97 |
| 4,805,545 | 2/1989 | Groth | 114/90 |
| 4,825,792 | 5/1989 | De Vos | 114/90 |
| 4,964,353 | 10/1990 | Morrelli | 114/39.2 |

FOREIGN PATENT DOCUMENTS

| | | | |
|---|---|---|---|
| 3629301 | 3/1988 | Fed. Rep. of Germany | 114/39.2 |
| 2576276 | 7/1986 | France | 114/90 |

*Primary Examiner*—Sherman Basinger
*Attorney, Agent, or Firm*—Henderson & Sturm

[57] ABSTRACT

A convertible mast assembly (10) for employing a windsurfing sail assembly (200) on a sailboat (100) having a drop-in mast receptacle (101); wherein, the mast assembly (10) comprises a receptacle unit (11) which fits in said drop-in mast receptacle (101); and, an adaptor unit (11) having one end (31) dimensioned to be received in the receptacle unit (11) and having the other end (33) dimensioned to be received in the mast (201) of the windsurfing sail assembly (200).

5 Claims, 2 Drawing Sheets

CONVERTIBLE MAST ASSEMBLY

TECHNICAL FIELD

The present invention relates to mast assemblies, and in particular to a convertible mast assembly that allows the user to install a sailboard sail onto a conventional sailboat.

BACKGROUND ART

As can be seen by reference to the following U.S. Pat. Nos. 4,964,353; 4,805,545; 4,825,792; and 4,757,778; the prior art is replete with myriad and diverse mast mounting arrangements for sailboards.

While all of the aforementioned prior art constructions are more than adequate for the basic purpose and function for which they have been specifically designed, these patented arrangements do not address the concept involved in the present invention which is the provision of an adaptor assembly that will allow the user to employ a windsurfer sail on any small sailboat having a drop-in mast and no standing rigging.

In addition, this invention is particularly useful for those individuals who sail both sailboards and either Sunfish, Laser or Zuma class sailboats.

As a consequence of the foregoing situation, there has existed a longstanding need among those individuals who enjoy both windsurfing and small class sailboats for an adaptor assembly that will allow the sailboard sail and mast assembly to be installed on their sailboat; and, the provision of such a construction is a stated objective of the present invention.

DISCLOSURE OF THE INVENTION

Briefly stated, the convertible mast assembly that forms the basis of the present invention comprises in general, a receptacle unit adapted to be received in the mast hole of a sailboat; and, an adaptor unit adapted on one end to be received in the receptacle unit and provided on its other end with means for supporting a wind-surfer sail assembly.

In addition, the adaptor unit is further provided with a block and cleat assembly including rigging which is adapted to engage, control and maneuver the windsurfer sail in the conventional sailing configuration.

As will be explained in greater detail further on in the specification, the use of this convertible mast assembly allows various windsurfing sails to be employed on Sunfish, Laser and Zuma class sailboats in a conventional sailboat rigging; wherein, the substitution of the windsurfer sail, boom and mast will produce superior speed and handling characteristics over the conventional sailboat sail, boom and mast components.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figures 1, 5:
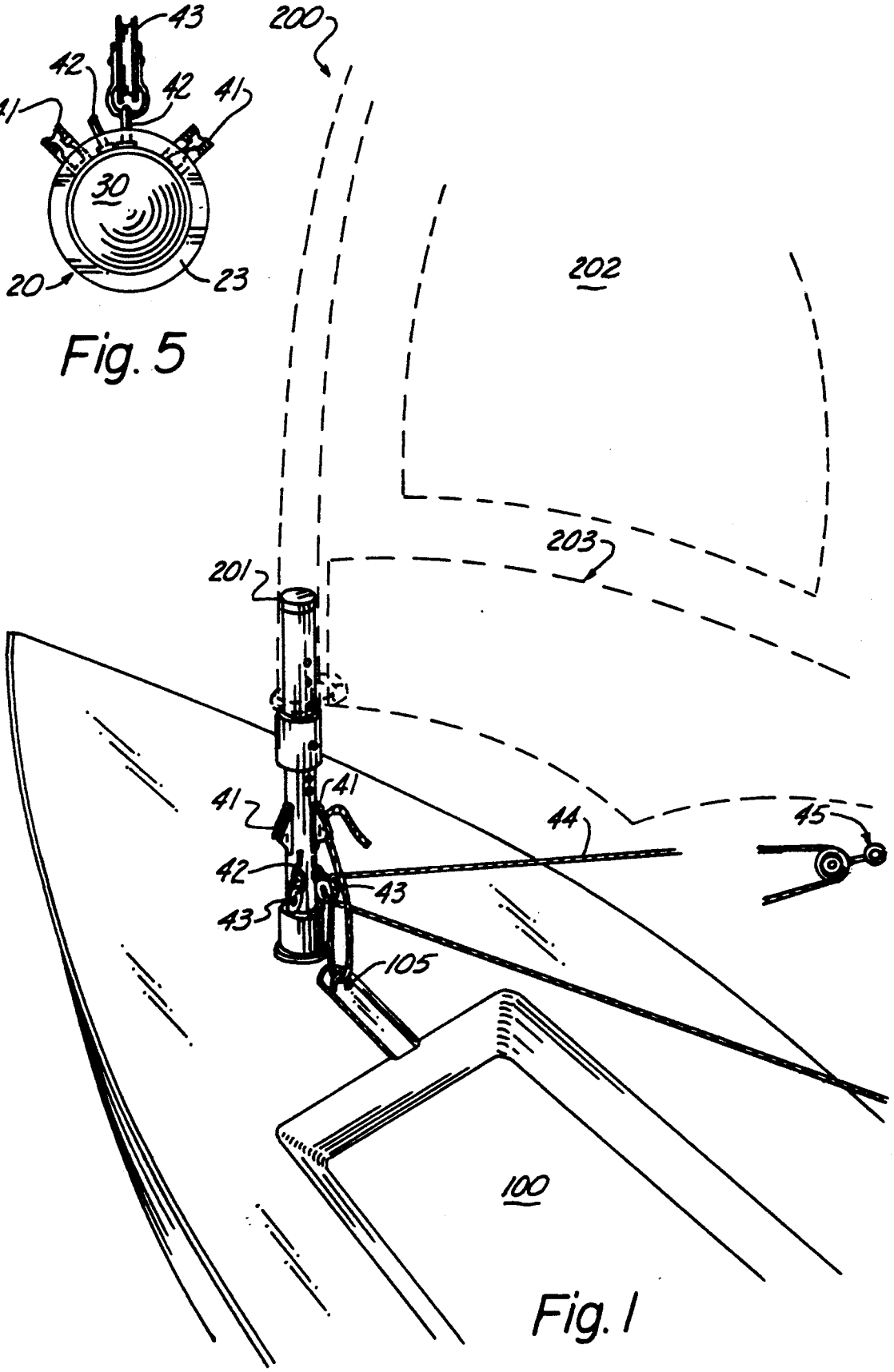
FIG. 1 is a perspective view of the convertible mast assembly of this invention deployed on a sailboat.
FIG. 5 is a top plan view of the convertible mast assembly.
Figure 2:
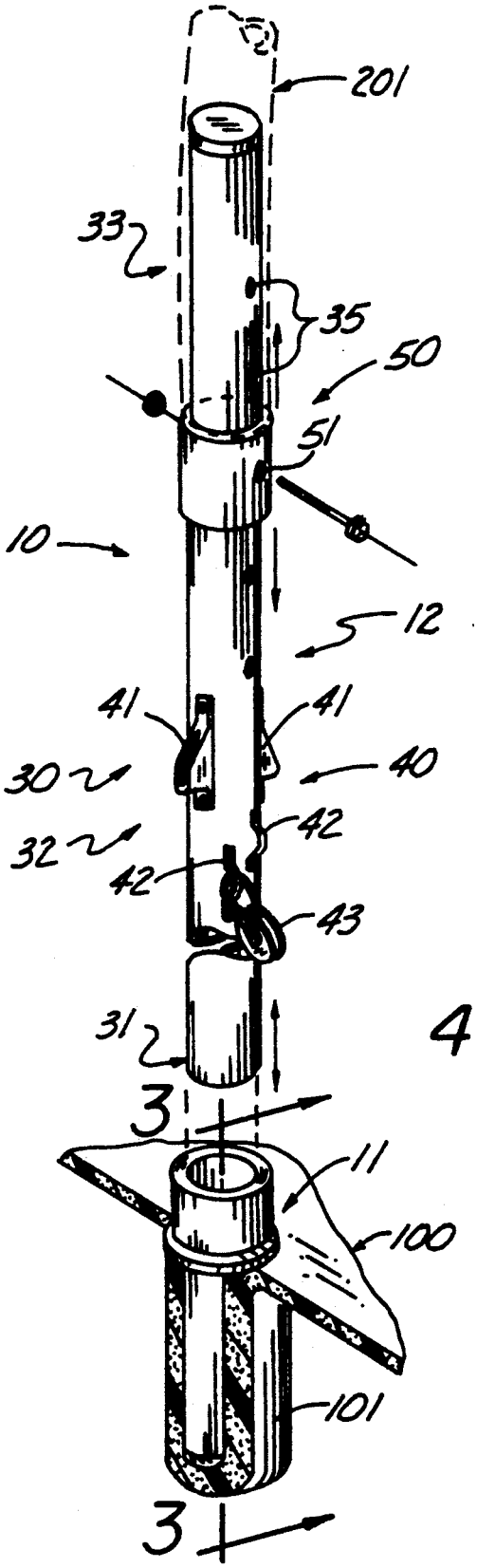
FIG. 2 is an exploded perspective view of the components of the convertible mast assembly.

As can be seen by reference to the drawings, and in particular to FIG. 1, the convertible mast assembly that forms the basis of the present invention is designated generally by the reference numeral (10). As shown in FIG. 2 the convertible mast assembly (10) comprises in general a receptacle unit (11) and an adaptor unit (12).

Figure 4:
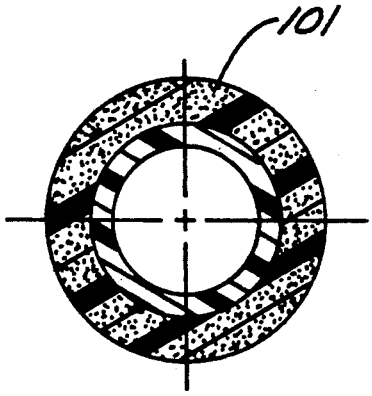
FIG. 4 is a cross-sectional view taken through line 4—4 of FIG. 3.
Figure 3:
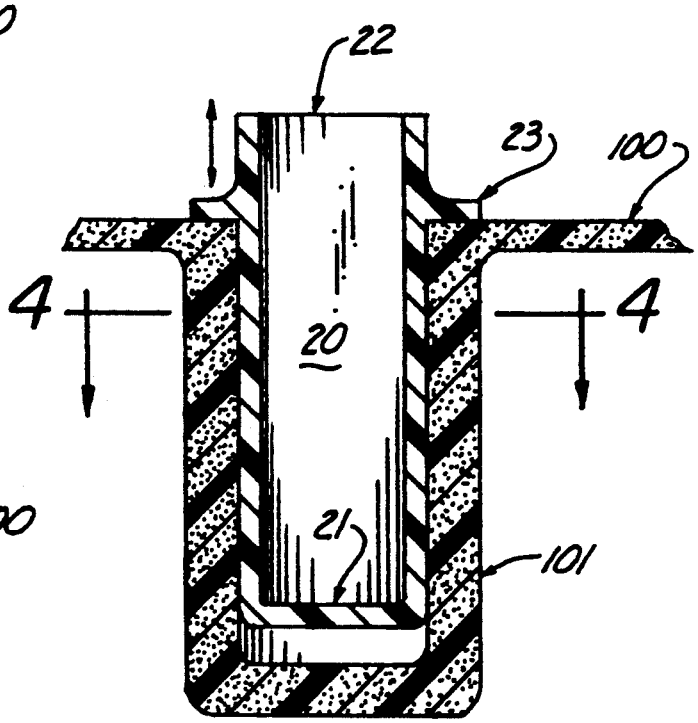
FIG. 3 is a cross-sectional view taken through line 3—3 of FIG. 2

As can be seen by reference to FIGS. 2 through 4, the receptacle unit (11) comprises a generally elongated cylindrical receptacle member (20) having: a closed bottom (21); an open top (22); and, a peripheral flange (23) which projects outwardly from a location disposed proximate to, but spaced from, the open top (22) of the cylindrical.

As shown in FIGS. 2 through 5, the sailboat hull (100) is provided with a drop-in mast receptacle (101); wherein, the exterior of the elongated cylindrical receptacle member (20) is dimensioned to be slideably received within the drop-in mast receptacle (101). In addition, the peripheral flange (23) of the receptacle member (20) will suspend the closed bottom (21) of the receptacle member (20) at or near the bottom of the drop-in mast receptacle (101) as depicted in FIG. 3. Turning now to FIGS. 1, 2 and 5, it can be seen that the adaptor unit (12) comprises an elongated cylindrical adaptor member (30) equipped with a block and cleat assembly designated generally as (40) and an adjustable collar element designated generally as (50).

As can be seen particularly by reference to FIG. 2, the lower portion (31) of the adaptor member (30) is dimensioned to be slideably received in the interior of the receptacle member (20); the intermediate portion (32) of the adaptor member (30) is equipped with the block and cleat assembly (40); and, the upper portion (33) of the adaptor member is both dimensioned to be received within the interior of the hollow mast (201) of a windsurfing sail assembly (200) and further provided with the adjustable locking collar element (50).

As shown in FIGS. 1, 2 and 5, the block and cleat assembly comprises a plurality of cleats (41) and eyelets (42) one of which is equipped with two blocks (43); wherein, conventional rigging lines (44) and a snap swivel (45) are employed to operatively connect the windsurfing sail (202) to the sailboat (100) in the conventional manner. In addition one of the eyelets (42) on the adaptor member (30) is included to provide a tethered connection between the adaptor member (30) and a suitable anchor eyelet (105) provided on the sailboat (100).

Furthermore, the rigging (44) controls the sail (202) wherein the rigging (44) starts at the conventional traveler, runs to the end of the boom (203) through a block (43) which is attached on the outhaul line by the snap swivel release hook (45) and then the rigging (44) runs forward to the lower block (43) and from there to the cockpit.

In addition to the foregoing, it should be noted that this arrangement employs a windsurfing mast (201) above the deck; provides a raised boom (203) above the headknocker range; and also allows the sail (202) to be downhauled by the block and cleat assembly (40) in a well recognized manner.

As can be seen particularly by reference to FIG. 2, the upper portion (33) of the adaptor member (30) is provided with a plurality of vertically aligned and spaced apertures (35); wherein, the collar element (50) is also provided with a complimentary aperture (51) dimensioned to receive a locking member (52); such that the collar element (50) may be selectively positioned at a desired height on the adaptor member (30) to vary the vertical spacing between the sail assembly (200) and the sailboat hull (100).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A convertible mast assembly to accommodate a conventional windsurfing sail assembly including the sail, boom and hollow mast onto a sailboat normally equipped with a drop-in mast receptacle and without standing rigging wherein the convertible mast assembly comprises:

a receptacle unit including a cylindrical receptacle member having: an open top; a closed bottom, which is dimensioned to be received within said drop-in mast receptacle; and, a flanged intermediate portion having a greater diameter than the diameter of the drop-in mast receptacle; and, an elongated generally cylindrical adaptor member having: a lower portion dimensioned to be received in the interior of said receptacle member; an intermediated portion equipped with a block and cleat assembly; and, an upper portion dimensioned to be received within the hollow mast of said conventional windsurfing sail assembly.

2. The convertible mast assembly as in claim 1; wherein said cylindrical receptacle member is further provided with a peripheral flange which is disposed proximate to, but spaced from the open top of said cylindrical receptacle member.

3. The convertible mast assembly as in claim 1; wherein, the upper portion of the adaptor member is further provided with an adjustable locking collar element which is slideably disposed on the adaptor member and whose external diameter is greater than the interior diameter of said hollow mast.

4. The convertible mast assembly as in claim 3; wherein, the block and cleat assembly comprises a plurality of cleats; blocks and eyelets.

5. The convertible mast assembly as in claim 4; wherein, the block and cleat assembly further comprises rigging lines and a snap release swivel hook adapted to engage one end of said boom.

* * * * *